US006722784B2

(12) United States Patent
Breil, Jr.

(10) Patent No.: US 6,722,784 B2
(45) Date of Patent: Apr. 20, 2004

(54) SNAP ON ENVELOPE

(76) Inventor: Gary L. Breil, Jr., 66 SE. 72nd Ave., Portland, OR (US) 97125

( * ) Notice: Subject to any disclaimer, the term of this patent is extended or adjusted under 35 U.S.C. 154(b) by 0 days.

(21) Appl. No.: 10/051,689

(22) Filed: Jan. 22, 2002

(65) Prior Publication Data

US 2003/0138170 A1 Jul. 24, 2003

(51) Int. Cl.[7] ..... B65D 33/16

(52) U.S. Cl. ..... 383/61.2; 383/63; 383/86; 383/95; 383/113; 229/78.2

(58) Field of Search ..... 229/77, 78.1, 78.2, 229/76, 79; 383/63, 61.2, 61.3, 84, 86, 108, 61.1, 95, 113

(56) References Cited

U.S. PATENT DOCUMENTS 1,970,307 A 8/1934 Hartmann
2,100,298 A * 11/1937 Baxter ..... 229/76
3,837,385 A 9/1974 Schelkman
4,190,162 A 2/1980 Buescher
4,334,618 A 6/1982 Buescher
5,244,136 A * 9/1993 Collaso ..... 224/673
5,816,709 A * 10/1998 Demus ..... 383/61.2
5,941,641 A * 8/1999 Kinigakis et al. ..... 383/86

* cited by examiner

*Primary Examiner*—Jes F. Pascua
(74) *Attorney, Agent, or Firm*—Theresa M. Seal

(57) ABSTRACT

A resealable watertight mailing envelope has a ziploc style strip for sealing the envelope closed. A flap portion is foldable over the ziploc seal, secured in the closed position by a snap closure. The envelope also has an interior watertight lining joined with the ziploc strip to seal the contents within from wetness or to prevent leakage of liquid items placed inside the envelope.

2 Claims, 3 Drawing Sheets

SNAP ON ENVELOPE

FIELD OF THE INVENTION

The present invention relates generally to an envelope enclosure for storing or mailing important papers, and more particularly, it relates to a ziploc™ style closure and a snap closure.

BACKGROUND OF THE INVENTION

Traditional envelopes are provided with a moisture activated glue strip along the closure flap, with which to seal a mailing envelope closed. This type of envelope is typically discarded after a single use, as the adhesive does not permit repeated sealing of the same envelope. Also, the paper used in these envelopes is normally of a non-waterproof material, so that one cannot store or send wet or damp items in them without messy leakage.

SUMMARY OF THE INVENTION

It is an object of the present invention to provide a reclosable envelope with a waterproof liner, with an additional snap closure for the flap.

Another object of the present invention is to provide an envelope for repeat usage, which can be reclosed for multiple usages and for permanent storage.

It is yet another object of the present invention to provide an envelope with two means of closure for safekeeping of documents and for mailed items.

What is disclosed is a resealable waterproof mailing envelope comprising an expandable pouch open at one end, and a waterproof interior lining portion. A recloseable sealing means is provided, adjacent an open end, which is integrally joined with the lining portion to form a liquid tight seal which retains liquid within said lining portion. Also included is a flap portion adjacent the open end, and a means for fastening the flap portion to securely close said flap portion over the sealing means adjacent the open end, to protect the contents therein, said fastening means also disengageable for removing said contents and refastenable for repetitive use. The recloseable sealing means comprises a ziploc type arrangement having opposable polyethylene strips, one said strip having a resilient protruding longitudinal rib portion, and a second said strip facing said first strip having a longitudinal channel adapted to engage said rib portion retentively to form a seal along said open end. In a preferred embodiment, the fastening means is comprised of a circular protruding ring portion attached to said flap portion and a circular receptacle portion attached to the exterior of said envelope removably interlockable with said ring portion such that when said flap portion is disposed over said open end to face said envelope the ring portion aligns with the receptacle portion such that a slight force compresses them into engagement providing additional stability and protection for said sealing means.

DETAILED DESCRIPTION OF THE DRAWINGS

Figure 1:
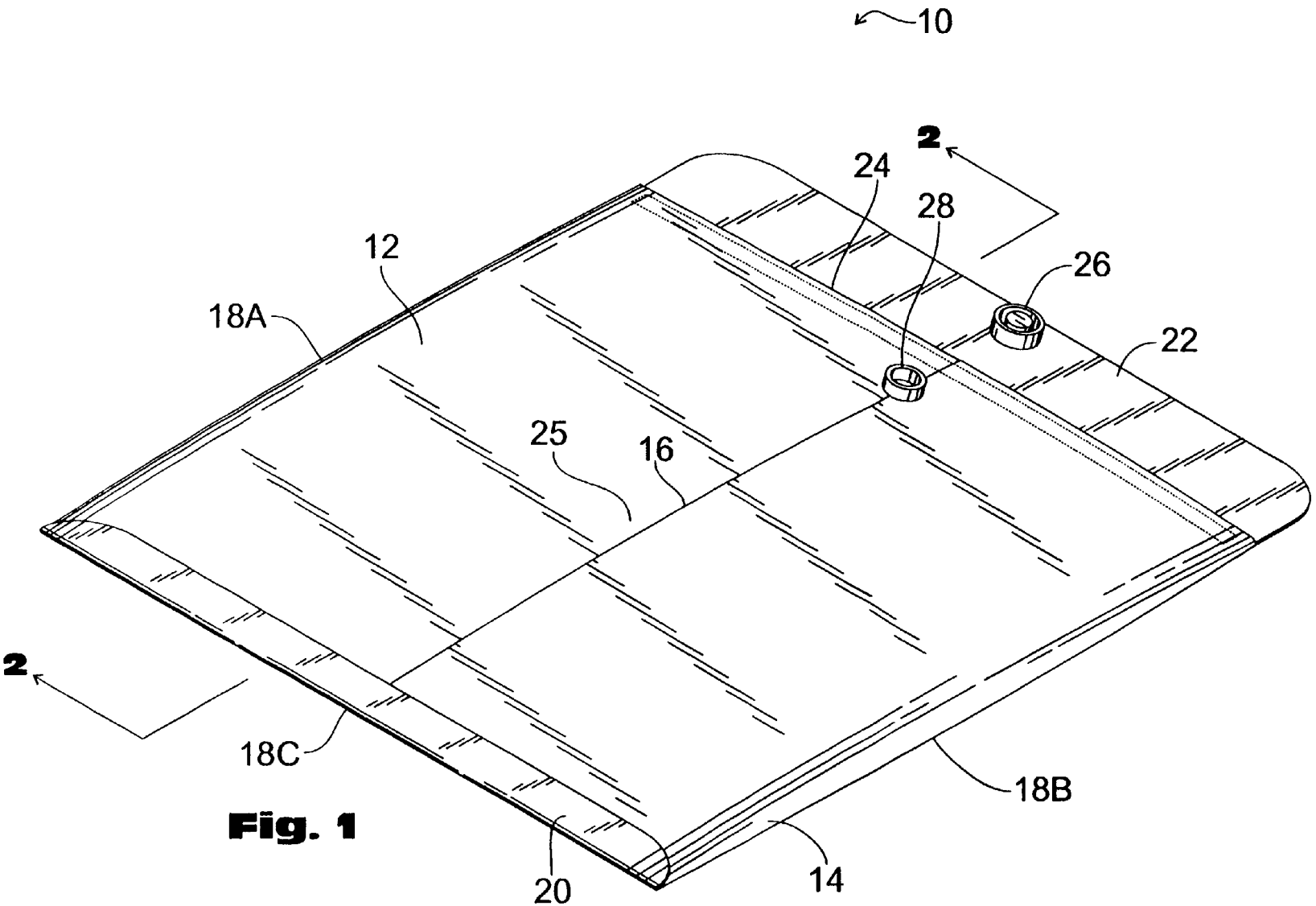
FIG. 1 is a perspective view of the resealable waterproof mailing envelope with one side facing up, in the open position.

Referring to FIG. 1, a resealable water tight mailing envelope is generally designated as 10. A first front panel 12 is adhesively joined with a second front panel 14 along a front seam 16 which forms a bisecting centerline. Side edge crease 18A and 18B form two perimeter edges of the front portion; and a third perimeter edge 18C is formed by a bottom sealed flap 20. The bottom sealed flap 20 is formed from an extension of back panel 30 folded over along perimeter edge 18C and adhesively sealed to front panel portions 12, 14. At the end of envelope 10 opposite perimeter edge 18C, a rear panel flap 22 is formed from a second extension of back panel 30 adjacent an open edge of envelope 10. Mounted on one face of rear panel flap 22 is a protruding ring portion 26. Protruding ring portion 26 cooperates to connect to a receptacle portion 28 mounted on the exterior face of envelope 10, comprised of first and second front panels 12, 14. Receptacle portion 28 is attached at the centerline seam 16 on front panel, 12, 14. When rear panel flap 22 is folded along open edge 24, protruding ring portion 26 aligns with receptacle portion 28 and when pressed together such as by a person's thumb or fingers, engage each other retentively, securing the flap in position over the open edge 24.

A margin edge 25 is provided as an extension of second front panel 14 which extends underneath the visible portion of first front panel 12 along front seam. Adhesive is applied to the opposing longitudinal margin created thereby in order to seal front panels 12, 14 along the centerline seam 16.

Figure 2:
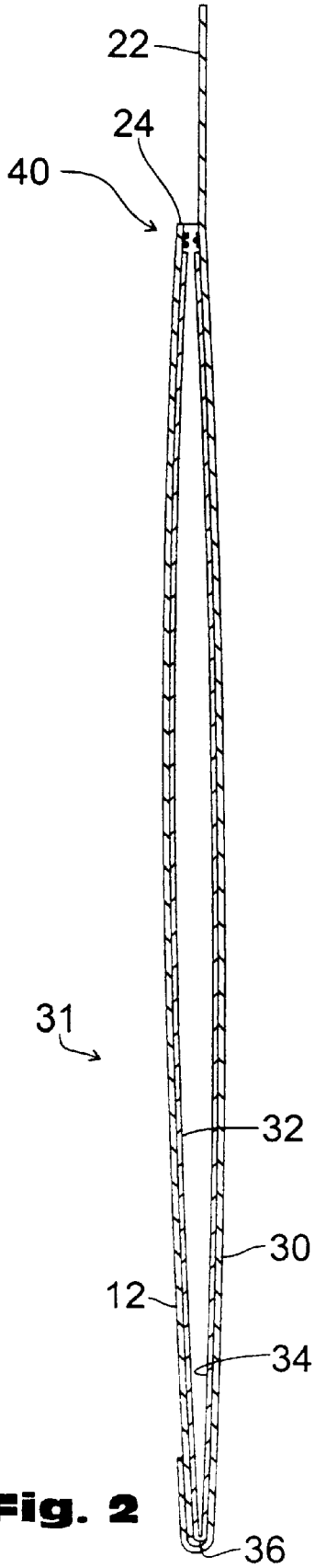
FIG. 2 is a sectional view taken along the lines 2—2 in FIG. 1.
Figure 3:
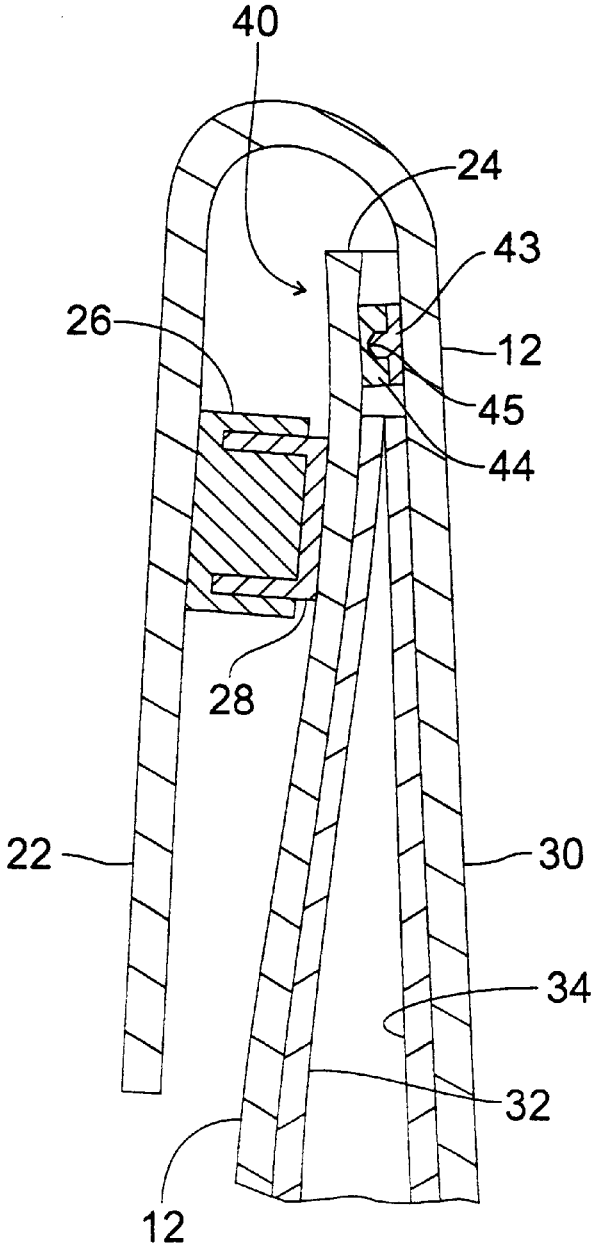
FIG. 3 is a fragmentary cross-sectional view showing the flap in the closed position and the ziploc strip sealed in the closed position.
Figure 4:
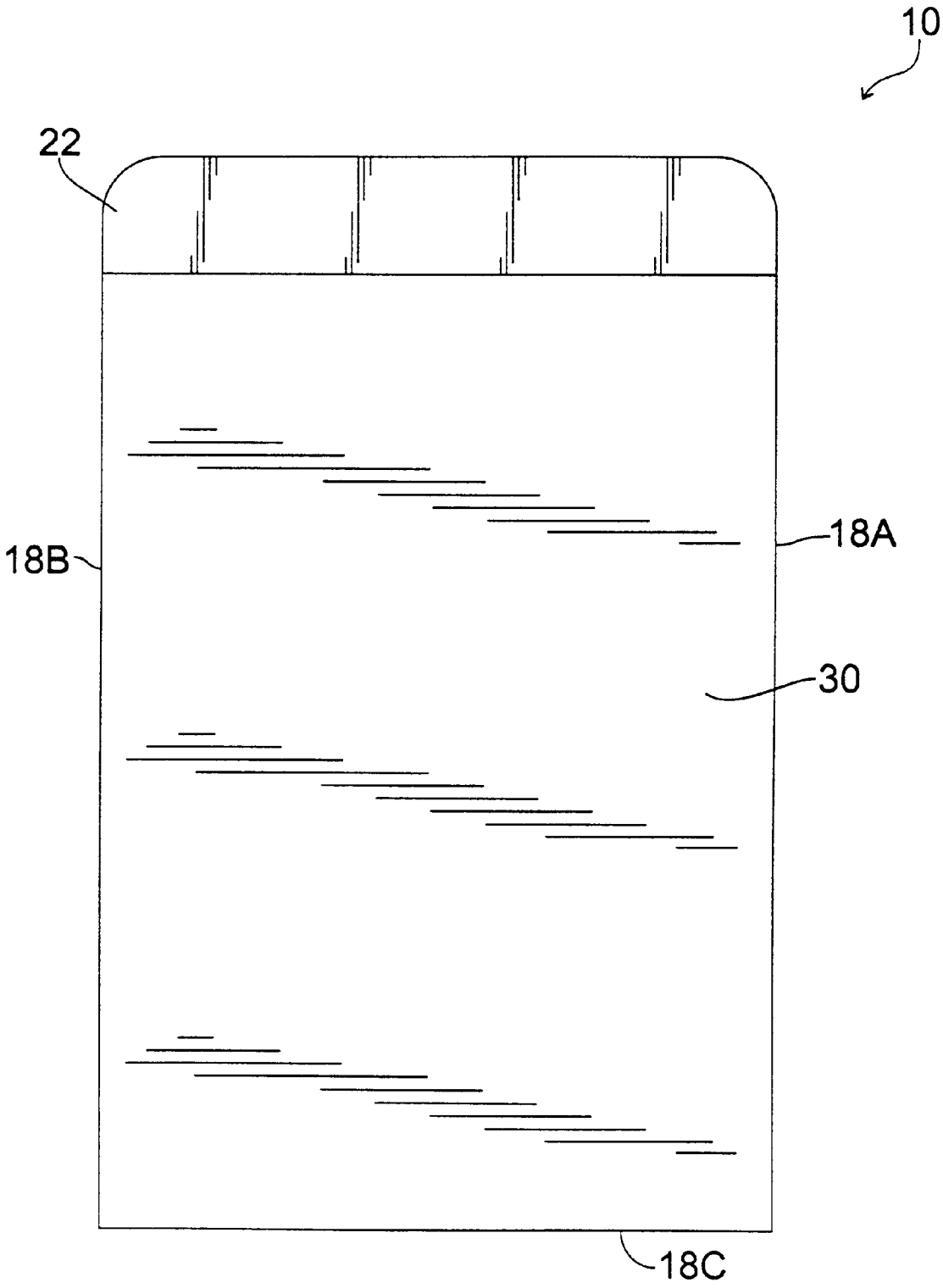
FIG. 4 is a rear elevational view of the resealable waterproof mailing envelope.

Referring now to FIG. 2, a cross sectional view taken along lines 2—2 of FIG. 1 illustrates the gap 31 formed between front panel 12 and back panel 30. A liner comprised of front panel 32 and rear panel 34 is adhesively fastened to the interior portions of front panels 12, 14 and rear panel 30. Said liner portions 32, 34 are continuous along liner bottom fold 36, to form a unitary waterproof barrier attached to the inner sides of front panels 12, 14 and back panel 30. Said liner panels 32, 34 are joined continuously at ziploc seal strips 44, 42.

Adjacent to open edge 24, a ziploc seal arrangement is provided. Ziploc seal strip 40 is comprised of opposing strips 42, 44. Strip 42 contains a longitudinal spline 43. Opposing strip 44 contains slot 45, into which spline 43 is removably engaged. Spline 43 and slot 45 are comprised of resilient waterproof material such as plastic, polyethylene, rubber or similar material. When pressed together, spline 43 and slot 45 cooperate to retain strips 44, 42 in a closed, sealed strip along the entire longitudinal edge adjacent edge 24. This reclosable sealed strip can later be opened by pulling spline 43 and slot 45 apart in order to remove contents from within the pouch shown as gap 31.

The flap portion 22 may be folded over edge 24 and seal strip 40, opposing front panel portions 12, 14. Thus protruding ring portion 26 is aligned with receptacle portion 28 to form a releasable snap which when engaged operates to retain flap portion 22 folded over edge 24 while being mailed or stored. This folded flap arrangement offers additional protection to the seal strip 40, thereby preventing accidental opening of the sealed strip and also reinforcing the closure of envelope 10.

Due to the recloseable and resealable nature of the envelope, it is intended that the recipient of the envelope reuse the envelope either for storage or mailing. Waterproof liner 32, 34, makes the envelope ideal for mailing damp or wet items. The moisture is sealed within thus preventing the release of liquid contents. Conversely, the water repellent liner 32, 34 keeps exterior wetness away from the contents sealed within the envelope.

According to the provisions of patent statutes, I have explained the principle, preferred construction and mode of operation of my invention and have illustrated and described what I now consider to represent its best embodiments. However, it should be understood that within the scope of the appended claims, the invention may be practiced otherwise and as specifically illustrated and described.

I claim:

1. A resealable waterproof mailing envelope comprising:

(A) an envelope forming an expandable pouch open at one end, said envelope having an inner wall:

(B) an interior lining portion comprised of waterproof material, said lining adhesively attached to said inner wall of said envelope:

(C) a reclosable sealing means adjacent said open end, integrally joined with said lining portion to form a liquid tight seal which retains liquid within said lining portion;

(D) said reclosable sealing means comprises an arrangement having a pair of opposable strips, a first strip having a resilient protruding longitudinal rib portion, and a second strip facing said first strip having a longitudinal channel adapted to engage said rib portion retentively to form a seal along said open end;

(E) a flap portion adjacent said open end;

(F) a means for fastening said flap portion to securely close said flap portion over the sealing means adjacent said open end, to protect the contents therein, said fastening means also disengageable for removing said contents and refastenable for repetitive use;

(G) said fastening means being comprised of a circular protruding ring portion attached to said flap portion and a circular receptacle portion attached to the exterior of said envelope removably interlockable with said ring portion such that when the said flap portion is disposed over said open end to face said envelope, the ring portion aligns with the receptacle portion such that a slight force compresses them into engagement providing additional stability and protection for said sealing means.

2. The resealable waterproof mailing envelope of claim 1 wherein, said opposable strips are comprised of a material selected from one of the following; polyethylene, plastic or rubber.

* * * * *